350-331 SR
PFR47 XR 4,093,335

United States Patent [19]
Schwartz et al.

[11] 4,093,335
[45] June 6, 1978

[54] ELECTRICAL CONNECTORS FOR COAXIAL CABLES

[75] Inventors: Oscar H. Schwartz, Brooklyn; Daniel A. Le Donne, Bronx, both of N.Y.

[73] Assignee: Automatic Connector, Inc., Commack, N.Y.

[21] Appl. No.: 761,475

[22] Filed: Jan. 24, 1977

[51] Int. Cl.[2] ..... H01R 17/04
[52] U.S. Cl. ..... 339/177 E; 174/89
[58] Field of Search ..... 339/177 R, 177 E; 174/89, 75 C, 88 C

[56] References Cited

U.S. PATENT DOCUMENTS

| | | | |
|---|---|---|---|
| 2,460,304 | 2/1949 | McGee et al. | 339/177 R |
| 2,761,110 | 8/1956 | Edlen et al. | 339/177 R |
| 3,107,135 | 10/1963 | Keil | 339/177 R |

FOREIGN PATENT DOCUMENTS

| | | | |
|---|---|---|---|
| 621,652 | 6/1961 | Canada | 174/89 |

*Primary Examiner*—Neil Abrams
*Attorney, Agent, or Firm*—Peter L. Berger

[57] ABSTRACT

An electrical connector for solid dielectric-filled coaxial cables which comprises three main elements is disclosed. A central contact wedge assembly is adapted to fit into a body and is held there by means of a nut assembly screwed into the body. Gripping means are provided between the body and wedge to prevent twisting of the cable and conductor as the connector is assembled. A lubricated washer located in the nut assembly further enhances the anti-twist action of this invention.

4 Claims, 3 Drawing Figures

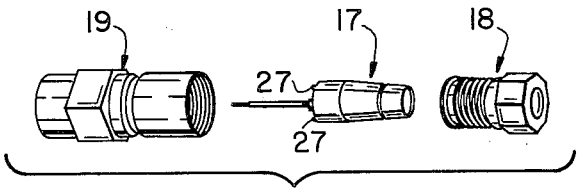
Fig. 1
Fig. 2
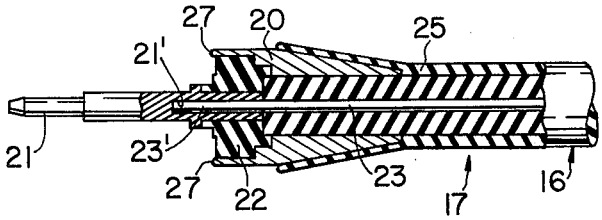
Fig. 3
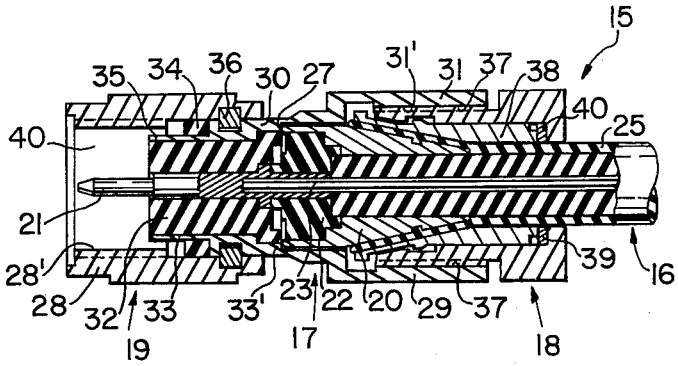

ELECTRICAL CONNECTORS FOR COAXIAL CABLES

BACKGROUND OF THE INVENTION

The present invention relates to electrical connectors for solid dielectric-filled coaxial cables and more particularly to the connector to be carried by an end of such cable for detachable connection to a mating terminal on a wave signal apparatus or another cable end.

The present invention relates to an improvement over a prior electrical connector described in U.S. Pat. No. 3,107,135, assigned to the same assignee-in fact as is the present application. It had been found that when the cable size was reduced significantly, such as by approximately one-half, catastrophic failure in the electrical continuity was encountered, when the nut was tightened into the body of the electrical connector. It was found that there was relative rotation of the cable with regard to a center conductor so that there frequently was a shearing of the center conductor causing the catastrophic failure in electrical continuity. Upon further discovery, it was found that the larger size cable utilized with U.S. Pat. No. 3,107,135 had sufficient surface area to prevent relative rotation between the electrical elements as the electrical connector is assembled by the nut being rotated into the body. As the size of cable became smaller, the gripping abilities were less reliable, and the above-described catastrophic failure occurred. Since the connector equipment is to be used with sophisticated and sensitive electronic equipment, such catastrophic failures cannot be permitted.

An object of this invention is to provide a novel and improved connector of the class mentioned, which securely clamps the cable without indentation of the cable dielectric and hence without disturbance of the cables impedance characteristic. The strength of the joint afforded by this connector is sufficient to withstand a pull on the cable greater than the inherent strength of the cable.

Another object of this invention is to provide such a connector which is adaptable with small size cable, such as 0.080 inches in which the electrical continuity is not impeded as the electrical connector is assembled.

The present electrical connector is substantially redesigned with respect to the earlier electrical connector, and so far as there are elements which are similar to that described in the prior patent, that description will be carried forward.

As an example of that, and as in the prior patent, a further object is to provide a connector of the type described which requires no special tools for assembly, which can be removed and its clamping parts reused and which needs no combing, trimming or removal of the braid outer conductor or of the dielectric therewithin, in preparation to mount the conductor onto the cable end.

Still a further object of this invention is to provide a novel and improved connector of the kind described, having the mentioned attributes and which is reasonable in cost, simple and easy to manipulate in mounting it or removing it and efficient in carrying out the purposes for which it is designed.

Other objects and advantages will become apparent as this disclosure proceeds.

SUMMARY OF THE INVENTION

In accordance with the principles of this invention, the above objects are accomplished by providing a connector which consists of three unitary parts, namely a body assembly, a contact wedge assembly and a nut assembly. The cable end on which the connector is to be mounted is trimmed to expose a short extending length of its axial conductor. The nut assembly is set as a sleeve on the cable away from its trimmed end. The contact wedge assembly is forced onto the cable end and includes a metal funnel-shaped part which enters into the tubular braid conductor of the cable while the exposed axial center conductor piece is received into the end of a hollow metal pin insulatively carried within said funnel-shape, thus effecting electrical connection with the cable's conductors. The nut assembly is brought to receive said funnel-shape inside of it whereby a ferrule part of the last mentioned assembly cooperates with said funnel-shape to act as a clamp. The body assembly receives said contact pin to extend axially within a tubular terminal and the nut assembly is threadedly coupled to said body assembly to form the connector into one structure.

The above description with regard to the present connector is substantially similar to the prior connector, and the present invention is distinguishable from the prior connector in the provision of means to avoid rotation of the wedge when the nut assembly is tightened on the cable. The hardness of the wedge is increased with relationship to that of the body, and, for example, the wedge is made of beryllium copper which is heat treated, while the body is typically made of brass or stainless steel. Locking teeth are provided on the wedge where it meets the body so there is no relative rotation between the body and wedge as the nut assembly is tightened on the cable.

As a further insurance against inadvertent relative rotation between the significant elements of the electrical connector, there is provided a lubricated washer-type bearing to lower the friction between the nut and ferrule, as the nut is tightened into the body and the connector is assembled.

BRIEF DESCRIPTION OF THE DRAWING

FIG. 1 is an exploded perspective view showing the three assemblies which comprise an electrical connector of this invention;

FIG. 2 is an enlarged sectional view of the central contact wedge assembly;

FIG. 3 is a sectional view similar to FIG. 2 showing the assembled connector, in accordance with this invention.

DETAILED DESCRIPTION

In the drawing, the numeral 15 designates generally the connector mounted at the end of a coaxial cable denoted generally by the numeral 16. The three principal parts of said connector are a contact wedge assembly indicated generally by the numeral 17, a nut assembly denoted generally by the numeral 18 and a body assembly shown generally by the numeral 19.

The contact wedge assembly 17 here shown, consists of a metal funnel-shaped element designated generally by the numeral 20, having a projecting contact 21 having a rearwardly directed elongated receptacle 21' in which the center conductor 23 of cable 16 is inserted for electrical connection to the contact 21. The frusto-conical tubular part or wedge 20 fixedly holds a dielectric piece 22. Let us consider for a moment that the nut assembly 18 which is a tubular structure, is set as a sleeve on the cable 16 away from the cable's end, where the cable has been trimmed to present a short length 23' of its axial conductor 23. Now, admit the cable's end into the hollow tubular stem or receptacle 21' of the funnel-form so that the bare central wire piece 23' enters the hollow in said receptacle and the wedge 20 shall enter the outer tubular braided conductor 25 of the cable until nearly the entire frusto-conical wedge or clamp 20 is within said hollow conductor to contact the same. A bore in the contact 21 is filled with solder applied through the bore in the exposed pin body. Thus, the contact wedge assembly is firmly secured to the cable and electrical connection is made with the respective conductors 23 and 25 to the parts 21 and 20 of the said contact wedge assembly.

In accordance with a principle of the present invention, when smaller diameter connectors were constricted in accordance with the teachings of the prior U.S. Pat. No. 3,107,135, it has been found that relative rotation was occurring to that center conductor 23 could shear during the assembly of the nut 18 into the body 19. One of the reasons for such shearing was the relative rotation between the body and wedge. As a feature of this invention, the wedge 20 of the contact wedge assembly 17 is made of a harder metal than that of the body 19. For instance, the wedge could be made of beryllium copper, which is heat treated. A set of teeth 27 is integrally formed with the wedge 20 to hold the wedge to the body, as will be described hereinafter. Since the body is made of a softer material than is the wedge, such as stainless steel, when the connector is assembled, the teeth grip into and hold onto the body enabling the wedge and body to be as one, thereby preventing relative rotation between the wedge and body and between the wedge and center conductor 23, which, in the past, had caused a shearing of the center conductor. Also, this connection of metal to metal between the body and wedge defines one of the electrical connections.

The body assembly 19 here shown includes a coupling nut 28 telescoping a body 29 with body 29 having a reduced portion 30 rotatable within member 28. One end of the coupling nut 28 is interiorly threaded as indicated at 28' to form a coupling member to be described below. The opposite end 31 of body 29 is also interiorly threaded at 31' to be joined to nut assembly 18. A centrally located annularly arranged solid tubular dielectric or insulator 32 is located within body 29. A thin metal wall 33 which is a part of the body encircles dielectric 32 and terminates in a body seat 33' where said dielectric and body abuts against the wedge during the connector assembly process. The teeth 27 are formed on the wedge 20 and are also circularly located around dielectric 22 of wedge assembly 17. The teeth 27 bite into the body seat 33' as the wedge is pressed against the body, during the assembly process.

A gasket ring 34 surrounds reduced near end 35 of thin wall 33 of body 29 and is located between said body and the inner surface of coupling nut 28. A retaining ring 36 also surrounds reduced near end 35 for the purpose of retaining the telescoped members 28 and 29 together.

Referring to FIG. 3, the nut assembly 18 is illustrated in detail and is provided with a tubular screw 37 for engagement with thread 31' of body 29, whereby the connector 15 is made as an assembled unit. An annularly located ferrule 38 is housed and held within nut assembly 18 and a lubricated washer 39 is located between one end of ferrule or clamp 38 and the inner facing end surface 40 of tubular screw 37 to permit the nut to rotate without causing rotation of the ferrule 38. The lubricated washer 39 may be an oilite bronze washer or any other such similar washer, and the ferrule 38 is adapted to bear against the frusto-conical shape of wedge 20 to effect the proper electrical connections by means of the wedge in accordance with the conventional practice. In order to insure that the connector 15 may be assembled without causing relative rotation of the cable 16 with respect to the wedge 20, the lubricated washer 39 is discussed above permits relatively free rotation of nut assembly 18 and its corresponding tubular screw 37 thereon.

The manner of mounting the connector parts 18 and then 17 onto the cable 16 as shown in FIG. 3 has already been set forth. Now take the body assembly 19, set it to house the contact wedge assembly 17 whereupon the contact pin 21 will slide fit into the central hole through dielectric partition 32 and extend into a socket area 40. The socket 40 is formed at the coupling end of a coupling member formed in the hollow of larger coupling nut 28.

The nut assembly is next brought toward the body assembly 19 and the tubular screw 37 is turned to engage the threads 31' thereby drawing said nut assembly 18 into said body assembly 19 which will cause the flared end of the tubular conductor 25 and its outer insulation covering 14 to be securely clamped through the pressure of ferrule 38 bearing against wedge 20.

Since the gripping teeth 27 of the wedge have been securely locked into the seat 33' of the body, the body and wedge will move as one, thereby preventing relative rotation of the center conductor 23 with respect to either the dielectric 32 or the wedge 20.

The coupling end comprises a conventional hexagon nut in which there is provided a recessed socket, with an inner thread surrounding the socket as at 28' to permit the outer threaded mating coupling member (not shown) to be connected to the connector 15 of this invention.

This invention is capable of numerous forms and various applications without departing from the essential features herein disclosed. It is therefore intended and desired that the embodiment herein shall be deemed merely illustrative and not restrictive and that the patent shall cover all patentable novelty herein set forth; reference being had to the following claims rather than to the specific description herein to indicate the scope of this invention.

What is claimed is:

1. An electrical connector for a coaxial cable of the type including a solid tubular dielectric having an inner conductor fitting therethrough and at least an outer tubular conductor covering along said dielectric, said connector comprising a contact wedge assembly, a body assembly and a nut assembly with said contact wedge assembly being pressed fit between said body and nut assemblies as they are connected together, said contact wedge assembly comprising an electrically conductive tapered funnel element for slidably receiving therein the end portion of the tubular dielectric of the cable whereby said tapered element shall lie between said dielectric and the outer tubular conductor of the cable and shall contact said outer tubular conductor, said contact wedge assembly comprising receptacle means to receive the extending bare end of the inner conductor, said nut assembly comprising an aperture to receive the cable and a clamping ferrule, said aperture terminating in said clamping ferrule, said ferrule capable of moving towards the end of the cable when the cable is associated with said tapered funnel element to cooperate with said tapered funnel element to clamp the outer tubular conductor of the cable between said ferrule and said tapered funnel element, said body assembly comprising a body telescoped in a coupling nut, said body comprising thin metal walls surrounding a central dielectric and terminating in a body seat facing said electrically conductive tapered element, and gripping means for holding said electrically conductive tapered element fixed to said body seat to prevent relative rotation between said inner conductor and said electrically conductive tapered element as said electrically conductive tapered element is pressed against said body seat, said gripping means comprising teeth extending oppositely from said taper, said teeth and said electrically conductive tapered element being integrally formed together and being of a metal material harder than the material of said body whereby edges of said teeth will bite into said body seat as said body and tapered element are drawn together.

2. An electrical connector as set forth in claim 1, wherein said harder metal material comprises heat treated beryllium copper.

3. An electrical connector as set forth in claim 1, wherein said nut assembly comprises a threaded cylindrical member adapted to be attached to said body by means of a relative motion and a washer means located between said clamping ferrule and said threaded cylindrical member permitting said threaded member to be screwed into said body without turning said ferrule.

4. An electrical connector as set forth in claim 3, wherein said washer means comprises a lubricated washer.

* * * * *